US005383257A

United States Patent [19]

Krauss

[11] Patent Number: 5,383,257

[45] **Date of Patent: * Jan. 24, 1995**

[54] CO-INJECTION MOLDED BUCKLE

[75] Inventor: Mark Krauss, E. Greenwich, R.I.

[73] Assignee: American Cord & Webbing Co., Inc., Woonsocket, R.I.

[ * ] Notice: The portion of the term of this patent subsequent to Sep. 8, 2009 has been disclaimed.

[21] Appl. No.: 42,987

[22] Filed: Apr. 5, 1993

[51] Int. Cl.[6] ..... A44B 11/00

[52] U.S. Cl. ..... 24/625; 24/616; 24/633; 24/637

[58] Field of Search ..... 24/625, 633, 616, 323, 24/587, 576, 637

[56] References Cited

U.S. PATENT DOCUMENTS

| | | | |
|---|---|---|---|
| 3,751,200 | 8/1973 | Borisuck et al. . | |
| 4,285,105 | 8/1981 | Kirkpatrick | 24/587 |
| 4,672,725 | 6/1987 | Kasai | 24/625 |
| 4,712,280 | 12/1987 | Feldan | 24/633 |
| 4,825,515 | 5/1989 | Wolterstorff, Jr. | 24/625 |
| 4,829,641 | 5/1989 | Williams | 24/587 |
| 4,942,649 | 7/1990 | Anthony et al. | 24/637 |
| 4,976,599 | 12/1990 | Pepe . | |
| 4,987,661 | 1/1991 | Kasai | 24/625 |
| 5,120,484 | 6/1992 | Cloeren . | |
| 5,131,122 | 7/1992 | Lavato | 24/625 |
| 5,144,725 | 9/1992 | Krauss | 24/625 |

*Primary Examiner*—Victor N. Sakran
*Attorney, Agent, or Firm*—Kane, Dalsimer, Sullivan, Kurucz, Levy, Eisele & Richard

[57] ABSTRACT

A buckle is coinjection molded from different resins to provide a visually distinguishable section to which digital pressure is applied to release the buckle. The protuberance of a spring arm of the male member to which digital pressure is applied may be injected molded of a different colored resin or a guard to which digital pressure is applied protects and extends over the projection. The different colored resin may also be luminescent.

7 Claims, 2 Drawing Sheets

CO-INJECTION MOLDED BUCKLE

BACKGROUND OF THE INVENTION

1. Field of the Invention

This invention relates generally to a buckle and more particularly to a buckle for releasable joining two ends of a belt, strap or the like.

2. Description of the Prior Art

The prior art is replete with buckle for releasable joining two end of a belt and .particularly side-release buckles for toolbelts, life preservers and jackets, backpacks, harnesses, seatbelts, scuba equipment and the like. Examples of such side-release buckles appear in U.S. Pat. Nos. 4,150,464, 4,282,634, 4,712,280, 4,825,515 and 5,447,725 as well as many others. However, one of the shortcoming of such prior art buckles is the inability or difficulty in immediately or quickly informing an individual, and, particularly visually, where to apply digitable pressure to release the buckle.

SUMMARY OF THE INVENTION

A principal subject of the present invention is to provide a buckle, and, particularly, a side-release buckle with visual indication of where digital pressure is to be applied to release the buckle.

Another object is to provide a buckle of the foregoing type where visual indication for digital pressure is provided by a coinjected resin of different color which may also be luminescent for easy identification in the dark.

A further object is to provide a buckle of the foregoing type which is rugged and reliable in operation and readily molded and manufactured at relatively low cost.

Briefly, a buckle in accordance with the present invention is injection molded of suitable resin and includes another resin which is coinjected to provide a visually distinguishable section or area to which is applied digital pressure to release the buckle. There is specifically disclosed a side-release buckle having the flexible arms of the male member of different material or a membrane of the female member adapted to cover the flexible arms of different material. This different material may be of a striking or contrasting color or luminescence that serves as a visual indication of where digital pressure is to be applied to release the buckle.

Other objects and advantages will become apparent from the following detailed description which is to be taken in conjunction with the accompanying drawing.

DETAILED DESCRIPTION OF THE ILLUSTRATED EMBODIMENTS

Figure 1:
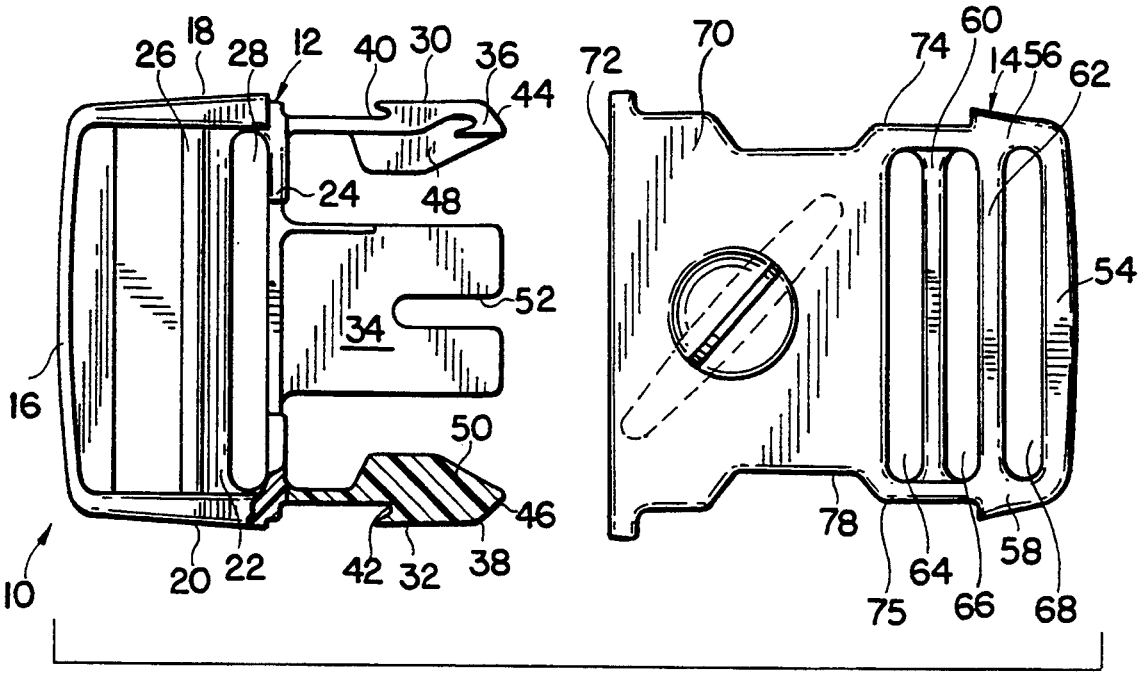
FIG. 1 is a front plan view, partly in phantom, of disattached male and female members of the buckle in accordance with a first embodiment of the invention.

Referring now to the drawing wherein like numerals indicate like elements throughout the several views, FIG. 1 discloses a buckle 10 including male member 12 and female member 14. The details of a similar buckle is disclosed in commonly assigned U.S. Pat. No. 5,144,725. Suffice it to say that the male member 12 includes C-shaped support 16 with horizontal members 18, 20 which engage belt support 22 and tongue support 24 therebetween. Openings 26, 28 are formed on both sides of belt support 22 so as to allow the passage of a belt (not shown) therethrough in a well known and conventional manner. Tongue support 24, which is attached to horizontal member 18, 20 of C-shaped support 16, and which is adjacent to opening 28, is integral with laterally projecting tongue 34 which include a centrally located longitudinal slot 52.

Spring arms 30, 32 of this invention also extend laterally from the tongue support 24 and are adapted to flex inwardly towards tongue 34. The free ends of spring arms 30, 32 include protuberances 36, 38, respectively, which in turn have concave hooked portions 40, 42, respectively. The protuberance 36, 38 further include tapered faces 44, 46 to urge or cam the spring arms inwardly as the spring arms are initially inserted into the female member 14. Inserts 48, 50 provide support for the protuberances 36, 38, respectively, and provide a guide for the internal locking function.

Figure 2:
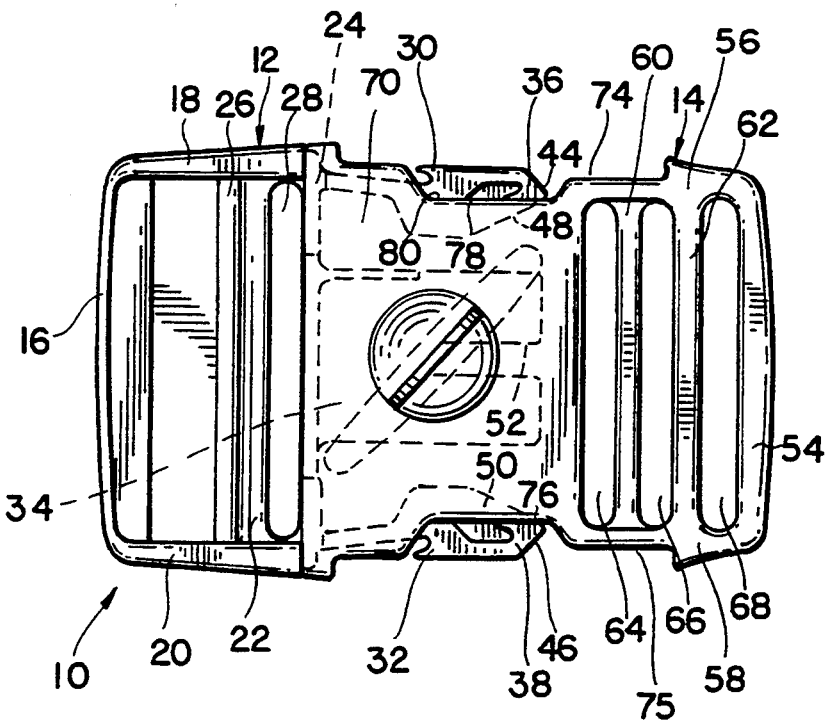
FIG. 2 is a front plan view, partly in phantom, of the attached male and female members of the buckle of FIG. 1.

Female member 18 includes a reverse C-shaped support 54 with horizontal members 56, 58. Belt supports 60, 62 are formed between the members 56, 58 thereby forming openings 64, 66, 68 through which a belt (not shown) passes. Body 70 extends from the ends of horizontal members 56, 58 and includes passageway 72 which faces male member 12 and which receives spring arm 30, 32 and tongue 34. On the lateral walls 74, 75 of body 70 are recesses 76, 78 which include apertures 80, 82. These apertures 80, 82 are adapted to receive protuberance 36, 38 of the respective spring arm 30, 32 of male member 12 to releasably latch this member to female member 14. As shown in FIG. 2, the protuberances 36, 38 extend through apertures 80, 82 and, consequently, are exposed. However, as apertures 80, 82 are within recesses 76, 78, protuberances 36, 38 are partially protected from inadvertent depression.

Tongue 34 which serves to guide the male member 12 into female member 14 may cooperate with structure of the type disclosed in any one of the above referenced applications and, consequently, will not be discussed in detail herein. Furthermore, details of the male member and final member may vary from that illustrated and described herein in as much as the essence of this invention, and, particularly with respect to the embodiment of FIGS. 1–2, is the formation of spring arm 30, 32 and in particular the respective protuberances 36, 38 from different visually discernable materials.

In accordance with the present invention, the male member 12 and female member 14 are injection molded from a suitable resin of a selected color. The arms 30, 32 on the other hand, are made from a different colored resin which is coinjected along with the resin for the remainder of the male member to form the arms. The arms 30, 32 under these circumstances may be a bright color, such as red, or luminescent or both so that the protuberances 36, 38 may be readily and easily discernable and recognized. In this manner, an individual will quickly recognize where digitable pressure must be applied to release the male part 12 from the female pat 14 and thus release the buckle. In lieu of the entire spring arm 30, 32 being of a different coinjected plastic, only protuberances 36, 38 may be so molded.

Figure 3:
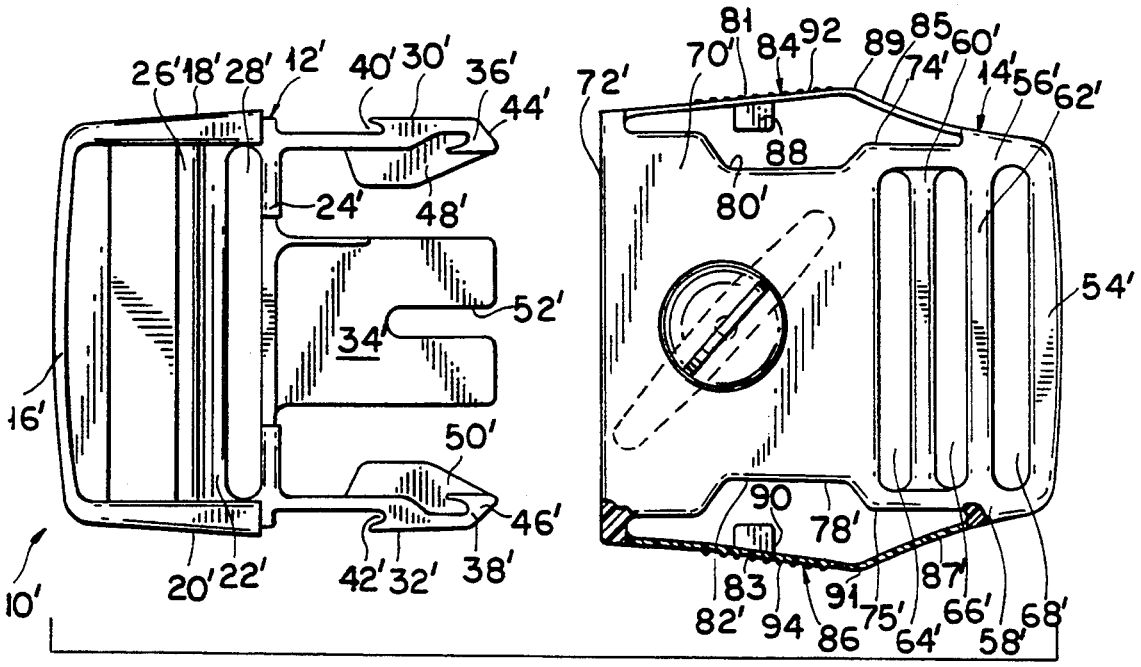
FIG. 3 is a front plan view, partly in phantom, of disattached male and female members of the buckle in accordance with a second embodiment of the invention.
Figure 4:
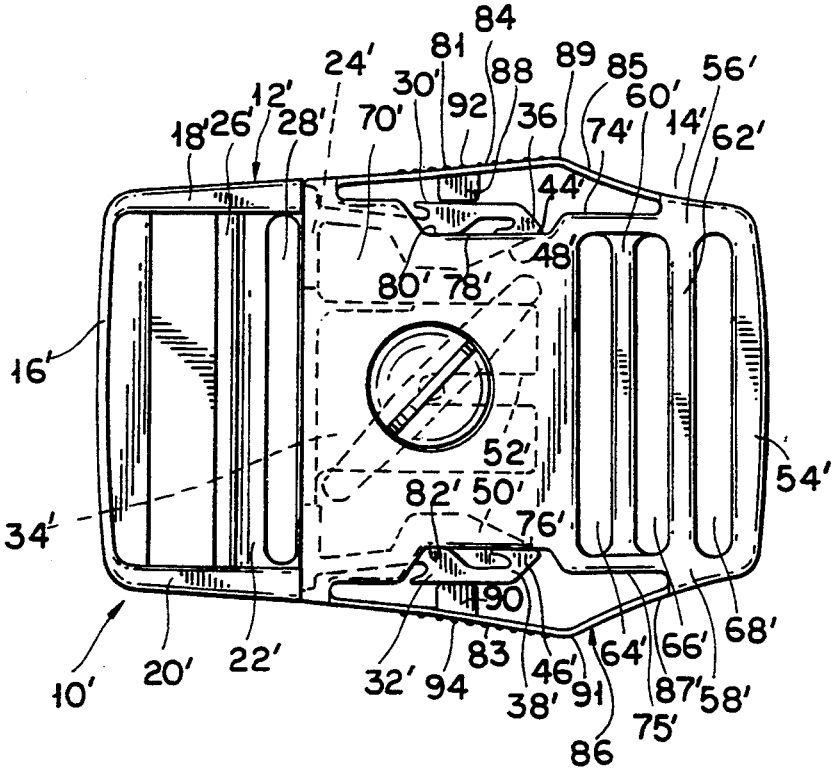
FIG. 4 is a front plan view, partly in phantom, of the attached male and female members of the buckle of FIG. 3.

In the embodiment of FIGS. 3–4 like parts will bear like numerals with accompanying primes. In this embodiment, lateral release membranes or guards 84, 86 may be of different colored coinjected resin as distinct from the arms 30, 32 of the first embodiment. These guards 84, 86 may be of any suitable contour and extend above recesses 76', 78' so as to further protect protuberances 36' 38' from inadvertent depression but, above all, they provide a visually discernible area to apply digital pressure to release the buckle. In accordance with the specific embodiment, release guards 84, 86 include section 81, 83 and 85, 87, respectively, which meet at an angle to form points of flexure 89, 91, respectively. The release guards may, optionally, include lugs or tabs 88, 90 which are adapted to engage protuberances 36', 38', respectively, when the release guards 84, 86 are depressed. Additionally, release guards 84, 86 may include serrations 92, 94, or the like, on the outward surfaces thereof to provide a firmer gripping surface. Thus, upon applying digital pressure to the readily visually discernable guards 84, 86 of different color, or luminescence or both, pressure will be applied to the respective protuberances 36', 38' to flex the respective arms 30, 32 inwardly to permit the male member 12 to be released from the female member 14.

Thus, the several aforenoted objects and advantages are most effectively attained. Although, several somewhat preferred embodiments have been disclosed and described herein, it should be understood that this invention is in no sense limited thereby and its scope is to be determined by that of the appended claims.

I claim:

1. A buckle comprising:.

a male member comprising at least one flexible inwardly movable spring arm having a free end and a protuberance at the free end thereof and guiding means;

a female member having an Opening receptive to said spring arm and including at least one lateral aperture through which said protuberance is exposed to releasably latch the male member to the female member, when the male member is engaged within the female member and guiding surfaces within the female member for cooperating with the guide means of the male member to guide the male member within the female member, whereby upon applying digital pressure to the protuberance the spring arm is flexed inwardly to release the male member from the female member;

a visual discernable means forming part of the buckle for visually indicating the location upon which digital pressure is to be applied in releasing the buckle, the visual discernable means being the protuberance of different color, the male member being injection molded from resin and wherein the visual discernable means being coinjection molded from a different color resin.

2. The invention in accordance with claim 1 wherein the visual discernable means is the entire spring arm.

3. The invention in accordance with claim 2 wherein the visual discernable means is luminescent.

4. The invention in accordance with claim 1 wherein the male member is provided with a pair of said spring arms and the female member is provided with a pair of lateral apertures for receiving the adjacent protuberance.

5. A buckle comprising:

a male member comprising at least one flexible inwardly movable Spring arm having a free end and a protuberance at the free end thereof and guiding means;

a female member having an opening receptive to said spring arm and including at least one lateral aperture through which said protuberance is exposed to releasably latch the male member to the female member, when the male member is engaged within the female member and guiding surfaces, within the female member for cooperating with the guide means of the male member to guide the male member within the female member, whereby upon applying digital pressure to the protuberance the spring arm is flexed inwardly to release the male member from the female member;

a visual discernable means forming part of the buckle for visually indicating the location upon which digital pressure is to be applied in releasing the buckle the visual discernable means being a flexible guard of different color extending outwardly from said female member adjacent to said at least one aperture so as to shield the adjacent protuberance from being inadvertently urged inwardly, and whereby the guard being adapted to be urged inwardly upon the application of digital pressure thereto to urge the protuberance inwardly to release the male member from the female member, the female member being injection molded from resin and wherein the guard being coinjection molded from a different colored resin.

6. The invention in accordance with claim 5 wherein the visual discernable means is luminescent.

7. The invention in accordance with claim 5 wherein the male member is provided with a pair of said spring arms and the female member is provided with la pair of lateral apertures for receiving the adjacent protuberance.

* * * * *